US006006825A

United States Patent [19]

Kitazaki

[11] Patent Number: 6,006,825

[45] Date of Patent: Dec. 28, 1999

[54] HEAT EXCHANGER

[75] Inventor: Satoshi Kitazaki, Oyamashi, Japan

[73] Assignee: Showa Aluminum Corporation, Osaka, Japan

[21] Appl. No.: 08/958,770

[22] Filed: Oct. 26, 1997

[30] Foreign Application Priority Data

Oct. 30, 1996 [JP] Japan ..... 8-288607

[51] Int. Cl.[6] ..... F28F 9/02

[52] U.S. Cl. ..... 165/173; 165/149

[58] Field of Search ..... 165/173, 149

[56] References Cited

U.S. PATENT DOCUMENTS

| | | | |
|---|---|---|---|
| 4,305,459 | 12/1981 | Nonnenmann et al. | 165/173 |
| 4,331,201 | 5/1982 | Hesse | 165/153 |
| 4,544,029 | 10/1985 | Cadars | 165/149 |
| 4,546,822 | 10/1985 | Tamura | 165/149 |
| 4,917,182 | 4/1990 | Beamer | 165/173 |
| 5,195,582 | 3/1993 | Haase | 165/173 |
| 5,201,368 | 4/1993 | Kroetsch | 165/173 |
| 5,390,733 | 2/1995 | Young | 165/173 |

*Primary Examiner*—Leonard Leo

[57] ABSTRACT

In a heat exchanger according to the present invention, a projecting edge portion integrally projects outward from an opening edge portion of a tank body, and a tank and a core plate are connected to each other in such a way that a claw portion of an edge portion of the core plate is caulked by being folded toward a back of the projecting edge portion, and the back of the projecting edge portion at the opening edge portion of the tank body and an outside surface of the tank body are continuously connected to each other by a curved surface. Accordingly, stress dispersedly acts on the connection portion between the tank and the core plate so that local stress concentration is prevented and breakage is prevented.

6 Claims, 4 Drawing Sheets

HEAT EXCHANGER

TECHNICAL FIELD

This invention relates to a heat exchanger which is used as, for example, a radiator or an intercooler.

RELATED ART

For example, as shown in FIGS. 3A and 4, the tank portion of a radiator has a structure in which a lower opening of a tank 51 having a U- or inverted U-shaped cross section is closed by a core plate 52 and a multiplicity of tubes 53 are connected to the tank 51 in the state of communicating therewith through the core plate 52. In FIG. 4, reference numeral 58 denote a fin provided between each of the tubes.

The tank 51 and the core plate 52 are integrated in the following manner. As shown in FIG. 3B, a projecting edge portion 55 is provided integrally with a tank body 54 of the tank 51 in such a manner as to project outward from the opening edge portion of the tank body 54. The core plate 52 is integrally provided with a C-shaped receiving edge portion 56 which extends along the edge portion of the core plate 52 and whose open side faces the tank 51. The outward projecting edge portion 55 of the tank 51 is fitted via a packing 59 into the C-shaped receiving edge portion 55 of the core plate 52, and an outward side portion 56*a* of the C-shaped receiving edge portion 56 is caulked by being folded toward a back 55*a* of the projecting edge portion 55 as a claw, whereby the tank 1 and the core plate 2 are integrated.

However, if the radiator having the above-described structure is mounted in a vehicle body as an engine cooling system, a breakage is likely to occur in the connection portion between the tank 51 and the core plate 52.

From detailed examinations which were conducted to investigate the causes of such breakage, it has been found out that there are some cases in which cracks are concentrically formed in an outside surface portion of the root portion of the projecting edge portion 55 in the opening edge portion of the tank 51. In addition, from the examination of a very fine portion, i.e., the shape of the root portion, it has been discovered that, as shown in FIG. 3C, an even chamfered slope 57 is present between the back 55*a* of the projecting edge portion 55 and an outside surface 54*a* of the tank body 54, and corner portions 60 are respectively present between the chamfered slope 57 and the back 55*a* of the projecting edge portion 55 and between the slope 57 and the outside surface 54*a* of the tank body 54.

Specifically, a load due to the outward side portion 56*a* as a claw of the core plate 52 which is caulked by being folded over the back 55*a* is applied to the back 55*a* of the projecting edge portion 55 of the tank 51 by the inner pressure of the tank 51 during the operation of the radiator and stress concentration is caused in each of the corner portions 60 by such load. Owing to this local stress concentration, cracks a are easily formed in an outside surface portion of the root portion of the projecting edge portion 55 in the opening edge portion of the tank 51, particularly, in the corner portions 60, with the result that a breakage is likely to occur in the connection portion between the tank 51 and the core plate 52. For this reason, it is common practice to ensure strength by increasing the wall thickness of the tank body 54 in the root portion of the tank body 54 and the projecting edge portion 55, but the increase in the wall thickness of the tank body 54 increases the amount of tank material used, posing a cost problem.

The present invention was made on the basis of the novel knowledge obtained from the detailed examination of the above-described very fine portion, and the object of the present invention is to provide a heat exchanger having a structure which can securely prevent breakage of the connection portion between a tank and a core plate.

DISCLOSURE OF INVENTION

The above object is achieved by a heat exchanger in which a core plate is disposed at an opening portion of a tank and the tank and the core plate are integrated in such a way that a claw portion of the core plate is caulked by being folded toward a back of a projecting edge portion which integrally projects outward from an opening edge portion of a tank body, characterized in that the back of the projecting edge portion and an outside surface of the tank body are continuously connected to each other by a curved surface.

Specifically, since the structure of the heat exchanger is such that the back of the projecting edge portion and the outside surface of the tank body are continuously connected to each other by the curved surface, no corner portions are present in the portion between the back of the projecting edge portion and the outside surface of the tank body, so that stress dispersedly acts on that portion to prevent local stress concentration and hence occurrence of cracks and breakage.

In particular, in order for the maximum stress acting on that portion to be reduced, it is preferable that the back of the projecting edge portion and the outside surface of the tank body be continuously connected to each other by a curved surface whose radius of curvature is 0.5 mm or more. It is also preferable that the back of the projecting edge portion and the outside surface of the tank body be continuously connected to each other by a curved surface whose radius of curvature is 1.5 mm or less, because this prevents the amount of projection of the projecting edge portion from becoming unnecessarily large.

The structure of the heat exchanger according to the present invention is such that a core plate is disposed at an opening portion of a tank and the tank and the core plate are integrated in such a way that a claw portion of the core plate is caulked by being folded toward a back of a projecting edge portion which integrally projects outward from an opening edge portion of a tank body, and the back of the projecting edge portion and an outside surface of the tank body are continuously connected to each other by a curved surface. Accordingly, no corner portions are present in the portion between the back of the projecting edge portion and the outside surface of the tank body, so that stress dispersedly acts on that portion to prevent local stress concentration, thereby effectively preventing occurrence of cracks and breakage. It is, therefore, possible to reduce the wall thickness of the tank body and hence the amount of tank material used in the root portion between the tank body and the projecting edge portion.

In particular, since the back of the projecting edge portion and the outside surface of the tank body are continuously connected to each other by a curved surface whose radius of curvature is 0.5 mm or more, stress acting on this portion is effectively dispersed so that occurrence of cracks and breakage can be prevented very effectively. In addition, since the back of the projecting edge portion and the outside surface of the tank body are continuously connected to each other by a curved surface whose radius of curvature is 1.5 mm or less, it is not necessary to unnecessarily increase the amount of projection of the projecting edge portion so that the claw portion of the core plate can be folded.

Furthermore, since it is only necessary to substitute a curved surface for the conventional even slope between the back of the projecting edge portion and the outside surface of the tank body, it is possible to easily prevent occurrence of cracks and breakage by means of a simple structure which is superior in practical terms.

BRIEF DESCRIPTION OF DRAWINGS

FIG. 1A is a cross-sectional view showing a tank portion of a radiator, FIG. 1B is a cross-sectional view showing on an enlarged scale the connection portion between a tank and a core plate, and FIG. 1C is a cross-sectional view enlarged to a further extent.

FIG. 3A is a cross-sectional view showing a tank portion of a radiator, FIG. 3B is a cross-sectional view showing on an enlarged scale the connection portion between a tank and a core plate, and FIG. 3C is a cross-sectional view enlarged to a further extent.

EMBODIMENT OF INVENTION

Figure 1A:
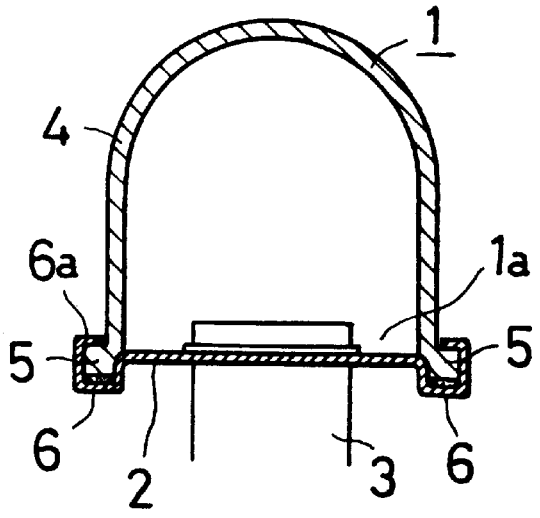
FIGS. 1A, 1B and 1C show one embodiment of the present invention.
Figure 1B:
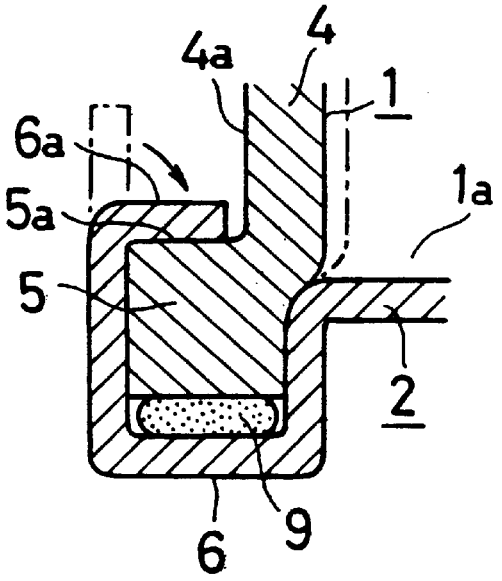

An embodiment of the invention will be described below. The present embodiment relates to a heat exchanger which serves as a radiator. As shown in FIGS. 1A and 1B, the structure of the radiator is such that a lower opening 1*a* of a resin-molded tank 1 having a U-shaped cross section is closed by a core plate 2 made of metal such as aluminum and a multiplicity of tubes 3 made of metal such as aluminum are connected to the tank 1 in the state of communicating therewith through the core plate 2. A projecting edge portion 5 which projects outward from the opening edge portion of a tank body 4 and has a rectangular cross section is provided integrally with the tank 1 in such a manner that a back 5*a* of the projecting edge portion and the outside surface of the tank body 4 make an angle of 90° or approximately 90°. The projecting edge portion 5 of the tank body 4 of the tank 1 is fitted via a packing 9 into a C-shaped receiving edge portion 6 which extends along the edge of the core plate 2, and an outward side portion 6*a* of the C-shaped receiving edge portion 6 is caulked by being folded toward the back 5*a* of the projecting edge portion 5 as a claw, whereby the tank 1 and the core plate 2 are integrated. The above structure is similar to that described previously in Background Art.

Figure 1C:
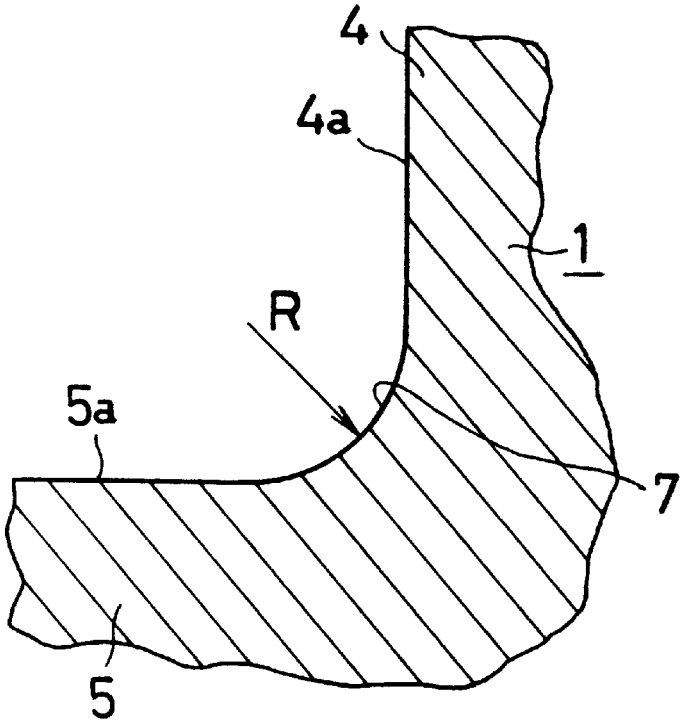

In such structure, as shown in FIG. 1C, the back 5*a* of the projecting edge portion 5 extending along the opening edge portion of the tank body 4 and an outside surface 4*a* of the tank body 4 are continuously connected to each other by a curved surface 7 with no corner portion formed therebetween.

Accordingly, if the radiator having such structure is mounted in a vehicle body and is used as an engine cooling system, stress acts on the outside surface portion of a root portion of the projecting edge portion 5 of the tank 1 by the action of internal pressure, but this stress dispersedly acts on this portion 7 so that local stress concentration is prevented and cracks and breakages are prevented from occurring in that portion. For this reason, unlike the conventional example shown by a dotted-dashed line in FIG. 1B, it is not necessary to make the wall thickness of the tank body 4 large to ensure strength in the root portion of the projecting edge portion 5 nor the tank body 4, so that the wall thickness of this portion can be made small.

Figure 2:
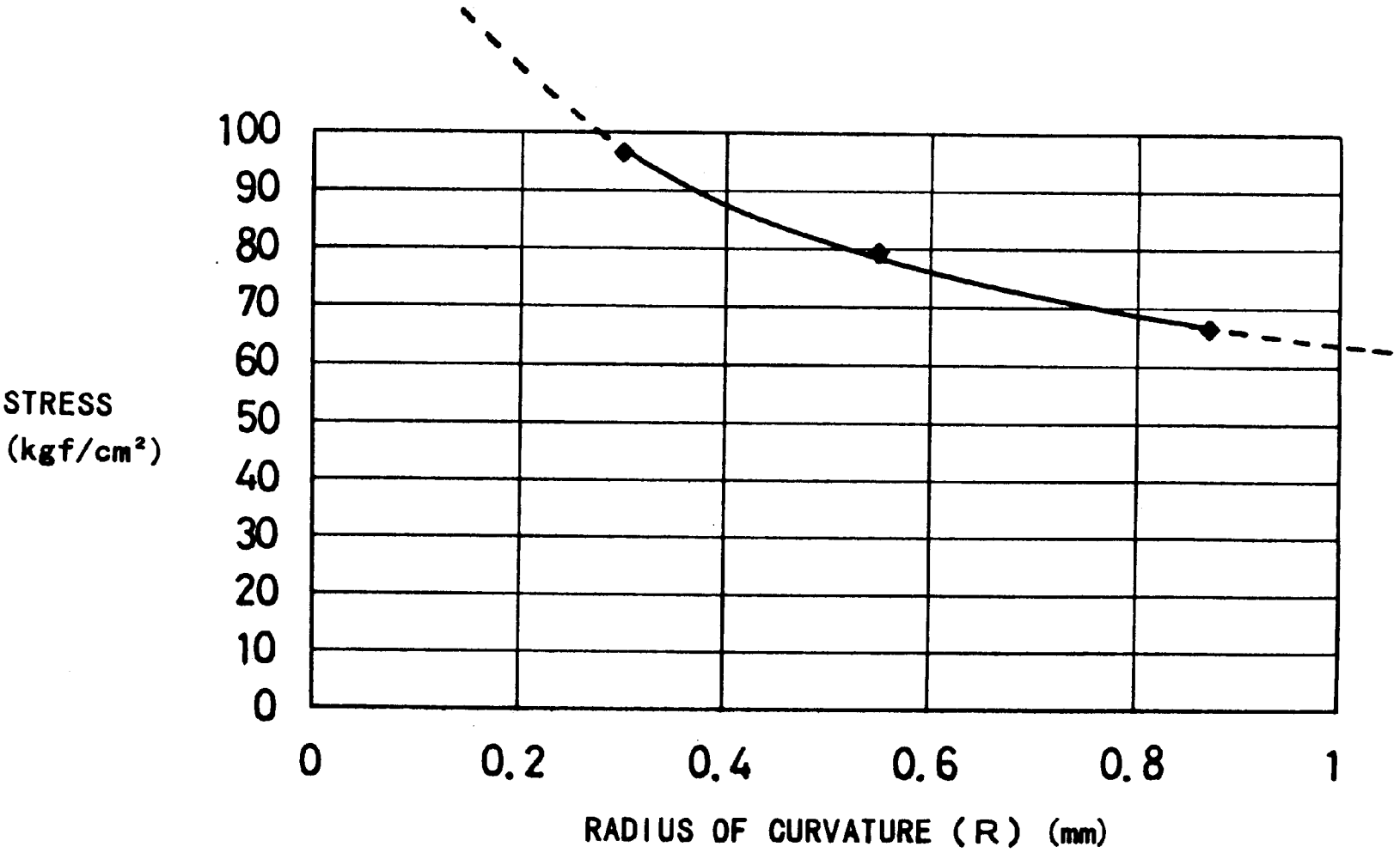
FIG. 2 is a graph showing the relationship between the radius of curvature of a curved surface portion and the maximum stress thereof.
Figure 3A:
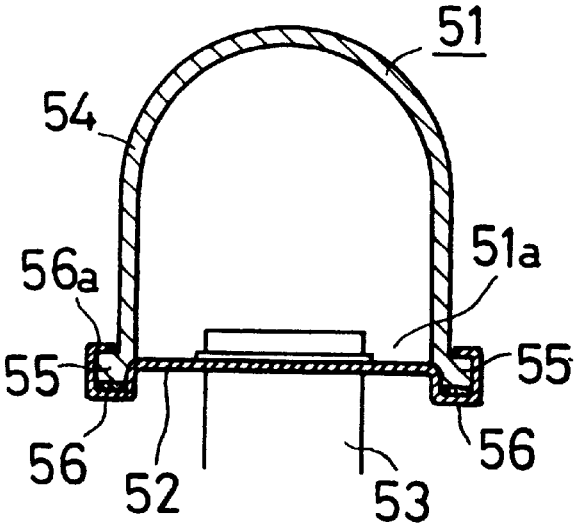
FIGS. 3A, 3B and 3C show a background art.
Figure 3B:
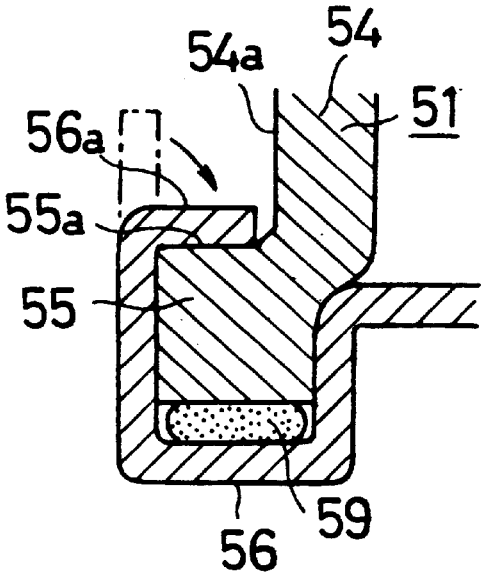
Figure 3C:
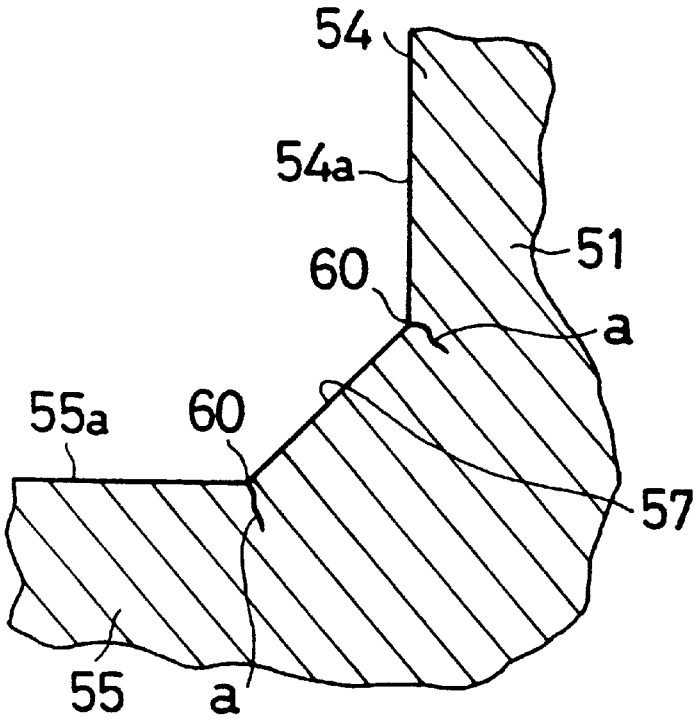
Figure 4:
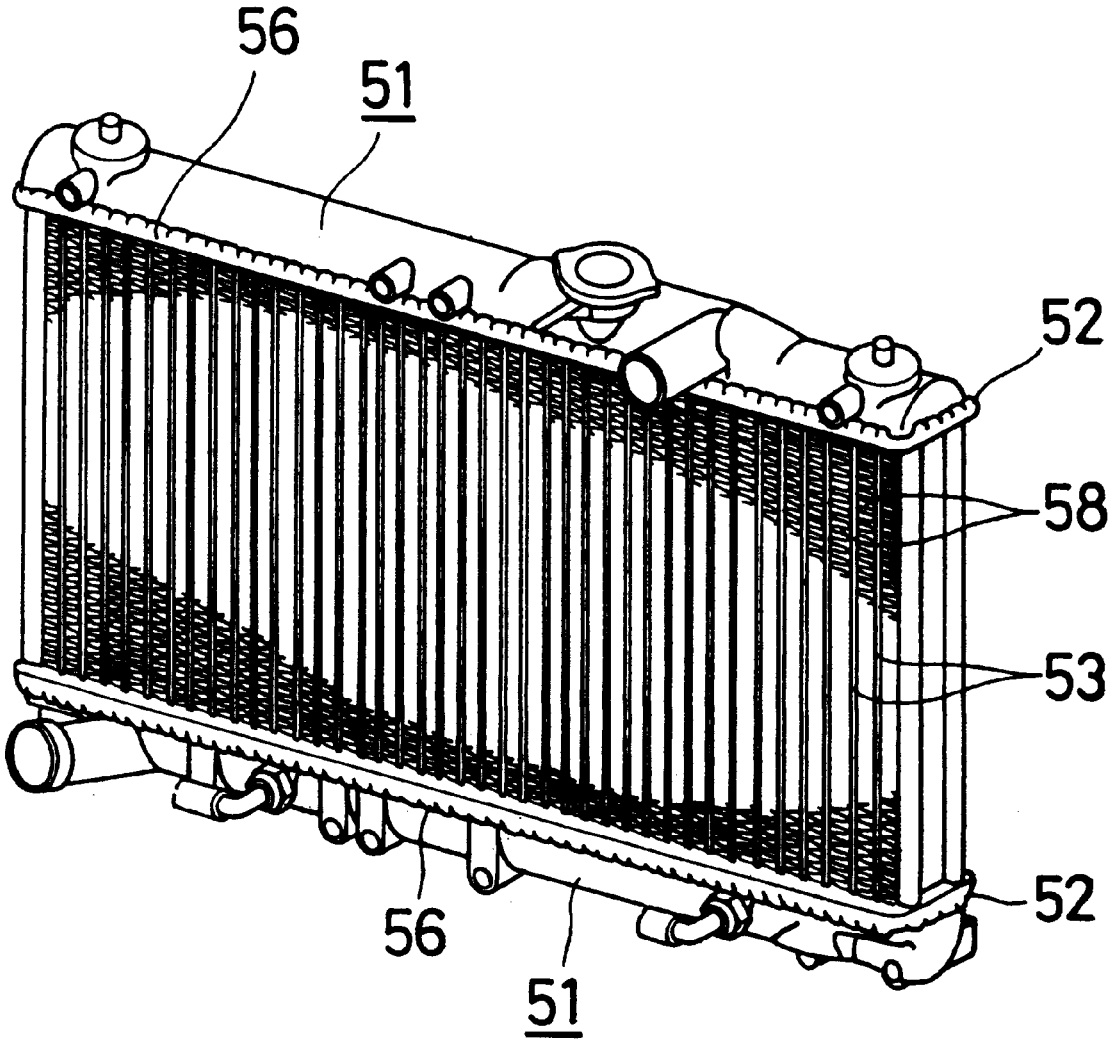
FIG. 4 is a perspective view of the radiator.

The result shown in the graph of FIG. 2 was obtained by measuring the maximum values of stress which acted on the curved surface portion 7 when a radius of curvature R of the curved surface portion 7 was variously changed with the inner pressure of the radiator fixed to 1.7 Kgf/cm$^2$. From this result, it has been confirmed that particularly if the radius of curvature R of the curved surfaced portion 7 is made 0.5 or more, the curve of stress values becomes gentle and an effective stress dispersion effect is achieved. As compared with the maximum stress which acts on the portion of the conventional example in which an even slope 57 is formed between a back 55*a* of a projecting edge portion 55 and an outside surface 54*a* of a tank body 54 and corner portions 60 are present on both ends of the even slope 57, it has been confirmed that the maximum stress value can be reduced by about 30%. A larger radius of curvature R of the curved surface portion 7 is more preferable in terms of the stress dispersion effect. However, if the radius of curvature R is made too large, it becomes necessary that the amount of projection of the projecting edge portion 5 be made unnecessarily large. It is, therefore, preferable to reduce the radius of curvature R to, for example, 1.5 mm or less.

Although one embodiment of the present invention has been described above, various variations can be made within the scope of the present invention. For example, although the above description has referred to an example in which the present invention is applied to a radiator, the present invention may also be applied to another heat exchanger such as an intercooler. The structure of the above embodiment is such that the projecting edge portion 5 of the tank 1 is fitted into the C-shaped receiving edge portion 6 which extends along the edge of the core plate 2, and the outward side portion 6*a* of the C-shaped receiving edge portion 6 is caulked integrally with the back of the projecting edge portion 5 by being folded toward the back as a claw. However, the present invention may also be applied to a construction in which a member which is separate from the body of the core plate 2 is connected thereto by caulking so as to extend from the edge portion of the core plate 2 to the back 5*a* of the projecting edge portion 5 of the tank 1. Further, although a resin-molded product is used as the tank 1 in the above embodiment, a metal-formed product may also be used.

It is to be understood that the terms and expressions used herein are solely for the purpose of illustration and are not to be restrictively construed, and are not intended to exclude any equivalent of the features illustrated and stated herein and various modifications may be made without departing from the claimed scope of the invention.

What is claimed is:

1. A heat exchanger comprising a tank and a core plate, said tank having a tank body, said core plate being disposed at an opening portion of the tank and said tank and said core plate being integrated in such a way that a claw portion of said core plate is caulked by being folded toward a back of a projecting edge portion which integrally projects outward from an opening edge portion of the tank body, and said back of said projecting edge portion and an outside surface of said tank body being continuously connected to each other by a curved surface whose radius of curvature is in the range of 0.5 mm to 1.5 mm.

2. A heat exchanger according to claim 1, characterized in that said back of said projecting edge portion and said outside surface of said tank body make an angle of 90° or approximately 90°.

3. A heat exchanger according to claim 1, characterized in that said tank is made of resin and said core plate is made of metal.

4. A heat exchanger according to claim 1, wherein said tank is made of resin, said core plate is made of metal, and said back of said projecting edge portion and said outside surface of said tank body make an angle of 90° or approximately 90°.

5. A heat exchanger according to claim 1, characterized in that a multiplicity of tubes are connected to said tank in the state of communicating therewith through said core plate.

6. A heat exchanger according to claim 1, wherein said tank is made of resin, said core plate is made of metal, said back of said projecting edge portion and said outside surface of said tank body make an angle of 90° or approximately 90°, and a multiplicity of tubes are connected to said tank in the state of communicating therewith through said core plate.

* * * * *

UNITED STATES PATENT AND TRADEMARK OFFICE

CERTIFICATE OF CORRECTION

PATENT NO. : 6,006,825
DATED : December 28, 1999
INVENTOR(S) : Kitazaki, Satoshi It is certified that error appears in the above-identified patent and that said Letters Patent is hereby corrected as shown below:

Claim 2, column 4,
Line 61, delete "characterized in".
Line 62, delete "that" and substitute therefor --wherein--

Claim 3, column 4,
Line 65, delete "characterized in".
Line 66, delete "that" and substitute therefor --wherein--

Claim 5, column 5,
Line 6, delete "characterized in"
Line 7, delete "that" and substitute therefor --wherein--

Signed and Sealed this

Tenth Day of July, 2001

Nicholas P. Godici

*Attest:*

*Attesting Officer*

NICHOLAS P. GODICI
*Acting Director of the United States Patent and Trademark Office*